US006302563B1

(12) United States Patent
Yama

(10) Patent No.: US 6,302,563 B1
(45) Date of Patent: Oct. 16, 2001

(54) LIGHTED CHECK HOLDER DEVICE

(76) Inventor: Ronald T. Yama, 1952 Mott-Smith Dr., Honolulu, HI (US) 96822

( * ) Notice: Subject to any disclaimer, the term of this patent is extended or adjusted under 35 U.S.C. 154(b) by 0 days.

(21) Appl. No.: 09/586,362

(22) Filed: Jun. 2, 2000

(51) Int. Cl.[7] ..... F21V 33/00

(52) U.S. Cl. ..... 362/253; 362/156; 362/99; 362/109; 362/427

(58) Field of Search ..... 362/98, 99, 154, 362/155, 156, 109, 253, 427

(56) References Cited

U.S. PATENT DOCUMENTS

| | | | | |
|---|---|---|---|---|
| D. 405,605 | | 2/1999 | Zimmerman | D3/247 |
| 1,202,498 | | 10/1916 | Findley | 362/99 |
| 2,392,516 | * | 1/1946 | Aronek | 362/156 |
| 2,572,095 | | 10/1951 | Baillie | 362/155 |
| 2,806,715 | * | 9/1957 | Smith | 281/44 |
| 3,671,059 | | 6/1972 | Zeller | 283/74 |
| 4,290,093 | * | 9/1981 | Thompson et al. | 362/98 |
| 4,320,838 | * | 3/1982 | Braver | 206/564 |
| 4,751,620 | * | 6/1988 | Wright et al. | 362/99 |
| 4,969,068 | | 11/1990 | Williams | 362/99 |
| 5,432,687 | * | 7/1995 | Lane | 362/99 |
| 5,813,748 | * | 9/1998 | Maxymych | 362/154 |
| 5,833,352 | * | 11/1998 | Goodwin | 362/156 |
| 5,877,852 | | 3/1999 | Schillbach et al. | 356/71 |

* cited by examiner

*Primary Examiner*—Sandra O'Shea
*Assistant Examiner*—Ronald E. DelGizzi

(57) ABSTRACT

A lighted check holder device for easily reading and completing the check or invoice transactions. The lighted check holder device includes a first cover member being hingedly attached to one of the side walls of the check support member and being closeable over the recessed portion in the top wall of the check support member; and further includes a light-emitting assembly for providing light to a check or invoice removably received in the recessed portion.

9 Claims, 2 Drawing Sheets

LIGHTED CHECK HOLDER DEVICE

BACKGROUND OF THE INVENTION

1. Field of the Invention

The present invention relates to a box-like check support device and more particularly pertains to a new lighted check holder device for easily reading and completing the check or invoice transactions.

2. Description of the Prior Art

The use of a box-like check support device is known in the prior art. More specifically, a box-like check support device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,671,059; U.S. Pat. No. 5,877,852; U.S. Pat. No. 2,572,095; U.S. Pat. No. 1,202,498; U.S. Pat. No. 4,969,068; and U.S. Pat. No. Des. 405,605.

While these devices fulfill their respective, particular objectives and requirements, the aforementioned patents do not disclose a new lighted check holder device. The inventive device includes a first cover member being hingedly attached to one of the side walls of the check support member and being closeable over the recessed portion in the top wall of the check support member; and further includes a light-emitting assembly for providing light to a check or invoice removably received in the recessed portion.

In these respects, the lighted check holder device according to the present invention substantially departs from the conventional concepts and designs of the prior art, and in so doing provides an apparatus primarily developed for the purpose of easily reading and completing the check or invoice transactions.

SUMMARY OF THE INVENTION

In view of the foregoing disadvantages inherent in the known types of box-like check support device now present in the prior art, the present invention provides a new lighted check holder device construction wherein the same can be utilized for easily reading and completing the check or invoice transactions.

The general purpose of the present invention, which will be described subsequently in greater detail, is to provide a new lighted check holder device which has many of the advantages of the box-like check support device mentioned heretofore and many novel features that result in a new lighted check holder device which is not anticipated, rendered obvious, suggested, or even implied by any of the prior art box-like check support device, either alone or in any combination thereof.

To attain this, the present invention generally comprises a check support member having a bottom wall, side walls, and a top wall having a recessed portion extending therein and being adapted to receive and support a check or an invoice; and also includes a first cover member being hingedly attached to one of the side walls of the check support member and being closeable over the recessed portion in the top wall of the check support member; and further includes a light-emitting assembly for providing light to a check or invoice removably received in the recessed portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted check holder device which has many of the advantages of the box-like check support device mentioned heretofore and many novel features that result in a new lighted check holder device which is not anticipated, rendered obvious, suggested, or even implied by any of the prior art box-like check support device, either alone or in any combination thereof.

It is another object of the present invention to provide a new lighted check holder device which may be easily and efficiently manufactured and marketed.

It is a further object of the present invention to provide a new lighted check holder device which is of a durable and reliable construction.

An even further object of the present invention is to provide a new lighted check holder device which is susceptible of a low cost of manufacture with regard to both materials and labor, and which accordingly is then susceptible of low prices of sale to the consuming public, thereby making such lighted check holder device economically available to the buying public.

Still yet another object of the present invention is to provide a new lighted check holder device which provides in the apparatuses and methods of the prior art some of the advantages thereof, while simultaneously overcoming some of the disadvantages normally associated therewith.

Still another object of the present invention is to provide a new lighted check holder device for easily reading and completing the check or invoice transactions.

Yet another object of the present invention is to provide a new lighted check holder device which includes a first cover member being hingedly attached to one of the side walls of the check support member and being closeable over the recessed portion in the top wall of the check support member; and further includes a light-emitting assembly for providing light to a check or invoice removably received in the recessed portion.

Still yet another object of the present invention is to provide a new lighted check holder device that conveniently allows a person to write upon a check or invoice with adequate light being provided for the person.

Even still another object of the present invention is to provide a new lighted check holder device that improves upon the check holders now provided by conveniently adding a light for the users thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
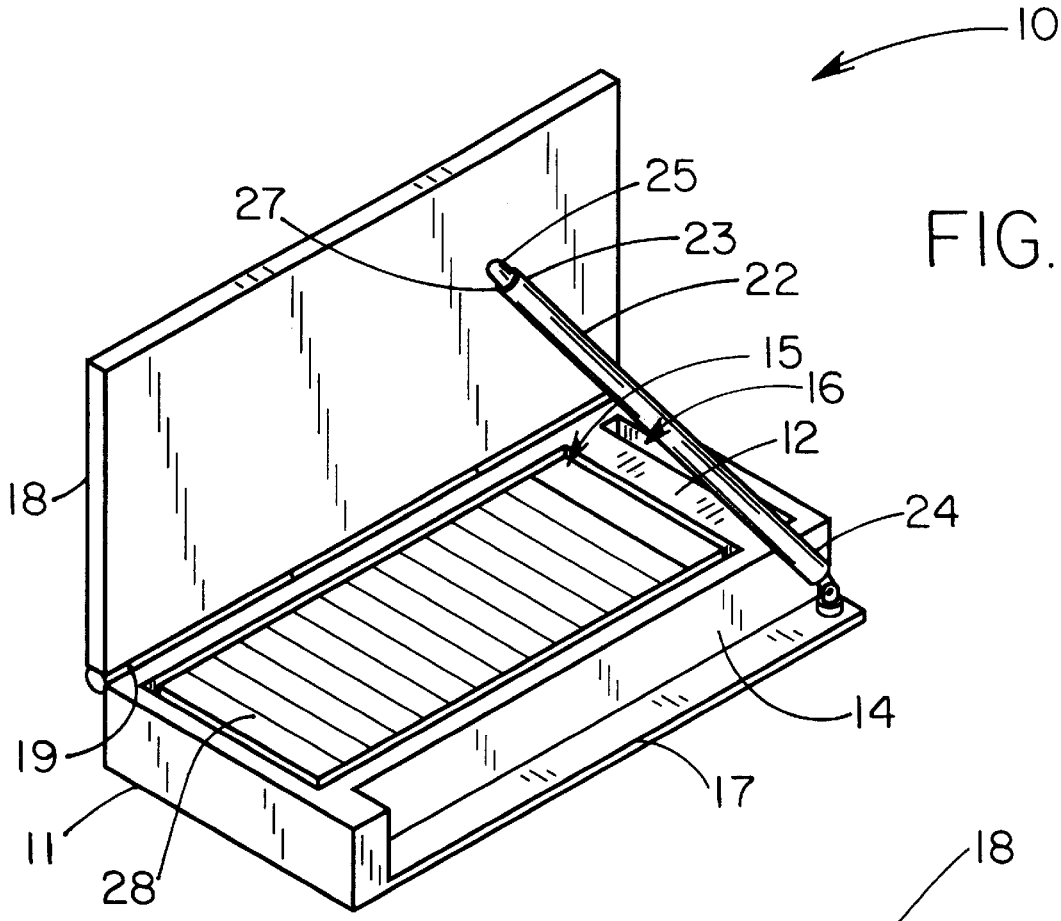
FIG. 1 is a top perspective view of a new lighted check holder device according to the present invention shown in use with the first cover member being opened.
Figure 2:
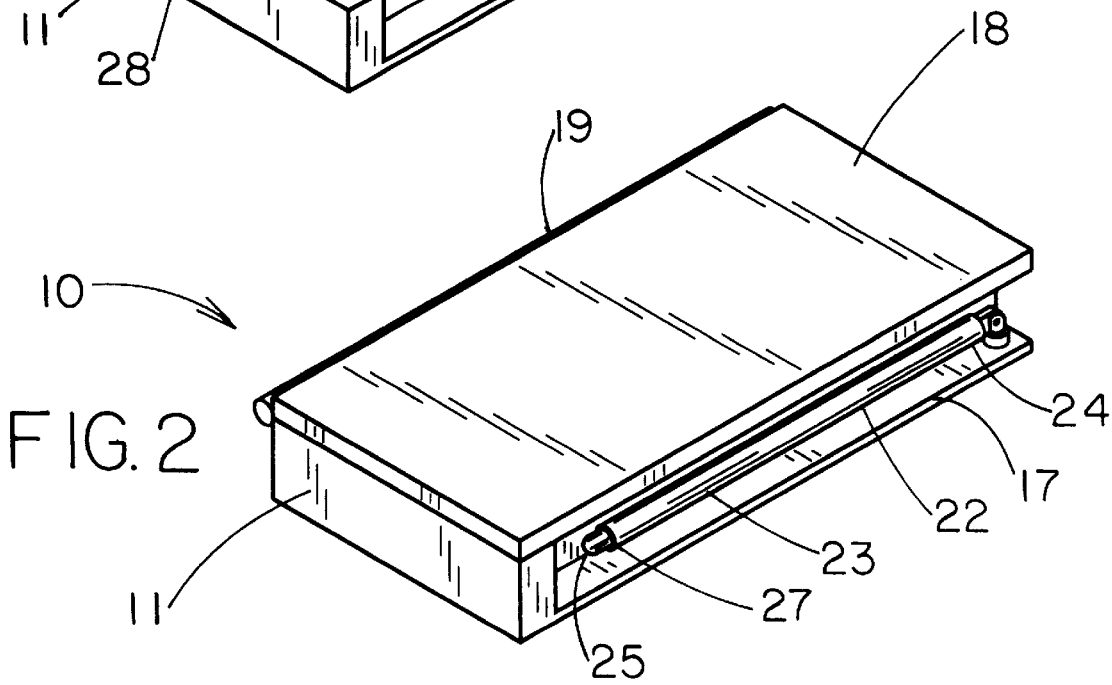
FIG. 2 is a top perspective view of the present invention with the first cover member being closed upon the recess portion of the check support member.
Figure 3:
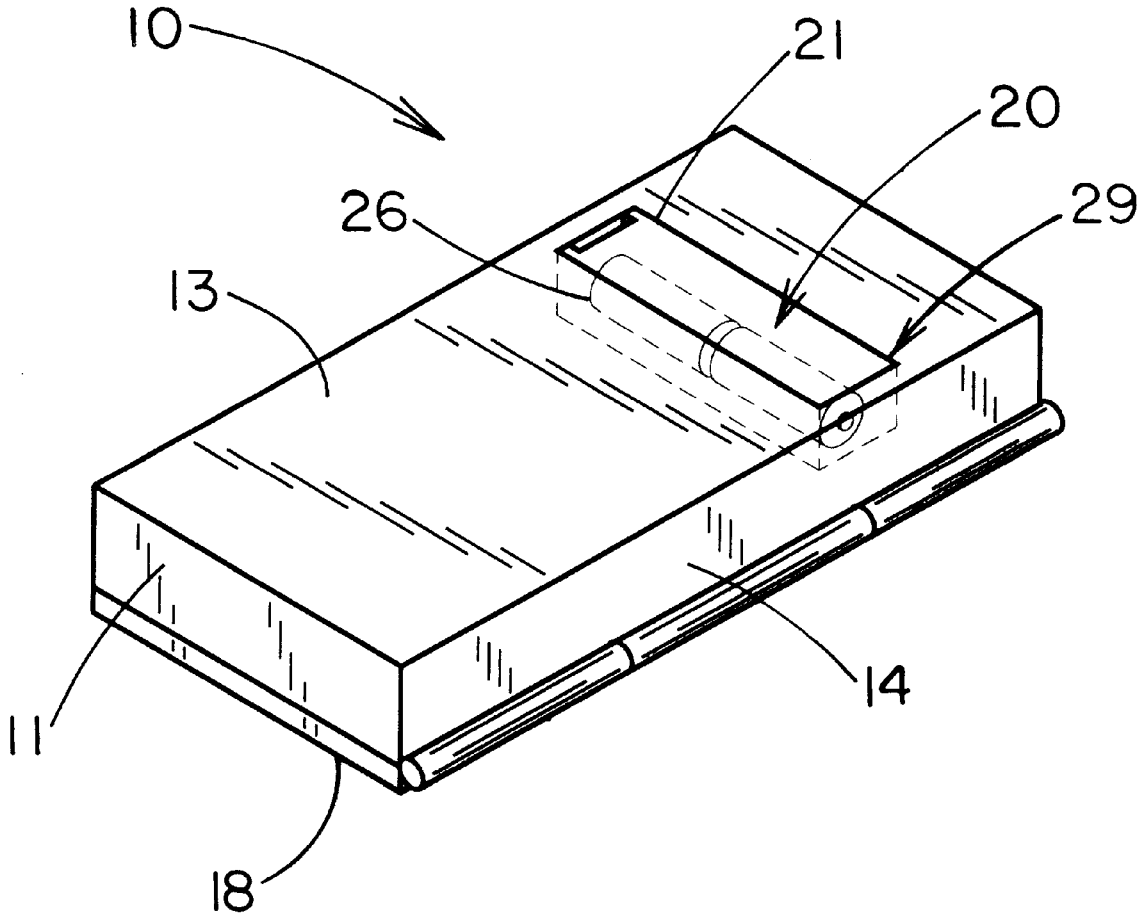
FIG. 3 is a bottom perspective view of the present invention.

With reference now to the drawings, and in particular to FIGS. 1 through 3 thereof, a new lighted check holder device embodying the principles and concepts of the present invention and generally designated by the reference numeral 10 will be described.

As best illustrated in FIGS. 1 through 3, the lighted check holder device 10 generally comprises a check support member 11 having a bottom wall 13, side walls 14, and a top wall 12 having a recessed portion 15 extending therein and being adapted to receive and support a check 28 or an invoice. The check support member 11 also includes a slot 16 extending in the top wall near 12 an end of the check support member 11 and being adapted to receive and support a credit card. The bottom wall 13 includes a ledge portion 17 extending therefrom and beyond one of the side walls 14 and being disposed parallel to the top wall 12 of the check support member 11 with the ledge portion 17 extending along a portion of a longitudinal side edge of the bottom wall 13. The check support member 11 includes a battery compartment 20 disposed inside thereof, and also includes an opening 29 extending through the bottom wall 13 into the battery compartment 20, and further includes a second cover member 21 which is removably attached to the check support member 11 for covering or closing the opening 29 in the bottom wall 13 thereof. The check support member 11 is essentially a rectangular box-like structure.

A first cover member 18 is hingedly and conventionally attached to one of the side walls 14 of the check support member 11 and is closeable over the recessed portion 15 in the top wall 12 of the check support member 11. The first cover member 11 includes a longitudinal side edge 19 which is hingedly attached along a top edge of the side wall 14 of the check support member 11.

A light-emitting means for providing light to a check 28 or invoice removably received in the recessed portion 15 includes an elongate light support member 22 having a first end 23 and a second end 24 which is pivotally and conventionally attached upon the ledge portion 17 of the bottom wall 13 of the check support member 11 and which is adapted to pivot above the recessed portion 15 of the check support member 11, and also includes a light-emitting member 25 securely, removably and conventionally disposed at the first end 23 of the elongate light support member 22, and further includes a power source 26 removably disposed in the battery compartment 20, and also includes a switch 27 conventionally connected to the power source 26 and to the light support member 22 for energizing the light-emitting member 25. The power source 26 includes batteries.

In use, the user opens the first cover member 18 and places the check 28 or invoice in the recessed portion 15 and then closes the first cover member 18 and takes it to the patron who then opens the first cover member 18 and turns on the light-emitting member 25 and pivots the elongate light support member 22 upon the check 28 or invoice so that the user can total and sign the check 28 or invoice with light being shined upon the check 28 or invoice. Once finished, the patron can turn off the light-emitting member 25 and pivot the elongate light support member 22 upon the ledge portion 17 and close the first cover member 18 upon the check 28 or invoice.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted check holder device comprising:

a check support member having a bottom wall, side walls, and a top wall having a recessed portion extending therein for receiving a check;

a first cover member being hingedly attached to one of said side walls of said check support member and being closeable over said recessed portion in said top wall of said check support member; and a light-emitting means for providing light to a check or invoice removably received in said recessed portion, said light-emitting means includes an elongate light support member having a free first end and a second end, the second end of said light support member being pivotally mounted on said bottom wall of said check support member, the free first end of said light support member being adapted to pivot above said check support member, a light-emitting member being removably mounted on the free first end of said light support member for illuminating a check mounted on the check support member;

wherein said light support member and said light-emitting member are mounted in a groove formed by a ledge portion of said bottom wall, one of said side walls of said check support member, and said first cover member such that said light support member may be pivoted from said groove when said first cover member is in an open position and when said first cover member is in a closed position.

2. A lighted check holder device as described in claim 1, wherein said check support member also includes a slot extending in said top wall near an end of said check support member and being adapted to receive and support a credit card therein.

3. A lighted check holder device as described in claim 1, wherein said ledge portion is disposed parallel to said top wall of said check support member.

4. A lighted check holder device as described in claim 1, wherein said ledge portion extends along a portion of a longitudinal side edge of said bottom wall.

5. A lighted check holder device as described in claim 1, wherein said first cover member includes a longitudinal side edge which is hingedly attached along a top edge of said side wall of said check support member.

6. A lighted check holder device as described in claim 1, wherein said check support member includes a battery compartment disposed inside thereof, and also includes an opening extending through said bottom wall into said battery compartment, and further includes a second cover member which is removably attached to said check support member for closing said opening in said bottom wall thereof.

7. A lighted check holder device as described in claim 6, wherein said light-emitting means further includes a power source removably disposed in said battery compartment; and also includes a switch connected to said power source and to said light-emitting member for energizing said light-emitting member.

8. A lighted check holder device comprising:

a check support member having a bottom wall, side walls, and a top wall having a recessed portion extending therein and being adapted to receive and support a check or an invoice, said check support member also including a slot extending in said top wall near an end of said check support member and being adapted to receive and support a credit card therein, said bottom wall including a ledge portion extending therefrom and being disposed parallel to said top wall of said check support member, said ledge portion extending along a portion of a longitudinal side edge of said bottom wall, said check support member including a battery compartment disposed inside thereof, and also including an opening extending through said bottom wall into said battery compartment, and further including a second cover member which is removably attached to said check support member for closing said opening in said bottom wall thereof, said check support member being essentially a rectangular box-like structure;

a first cover member being hingedly attached to one of said side walls of said check support member and being closeable over said recessed portion in said top wall of said check support member, said first cover member including a longitudinal side edge which is hingedly attached along a top edge of said side wall of said check support member;

a light-emitting means for providing light to a check or invoice removably received in said recessed portion, said light-emitting means including an elongate light support member having a free first end and a second end, the second end of said light support member being pivotally mounted on said bottom wall of said check support member, the free first end of said light support member being adapted to pivot above said check support member, a light-emitting member being removably mounted on the free first end of said light support member for illuminating a check mounted on the check support member, said light support member and said light-emitting member being mounted in a groove formed by saidledge portion of said bottom wall, one of said side walls of said check support member, and said first cover member such that said light support member may be pivoted from said groove when said first cover member is in an open position and when said first cover member is in a closed position; and a power source removably disposed in said battery compartment, and also including a switch connected to said power source and to said light-emitting member for energizing said light-emitting member, said power source including essentially batteries wherein said light support member is mounted for swivel movement with respect to said bottom wall.

9. A lighted check holder device as described in claim 1, wherein said light support member is mounted for swivel movement with respect to said bottom wall.

* * * * *